United States Patent [19]

Goldman et al.

[11] 4,376,964

[45] Mar. 15, 1983

[54] ELECTRICAL TREATMENT OF TEXTILE YARN OR FIBERS

[75] Inventors: Max Goldman; Daniel Le Fur, both of Gif sur Yvette; Michel Sotton, Boulogne sur Seine, all of France

[73] Assignee: Electricite de France (Service National), France

[21] Appl. No.: 237,707

[22] Filed: Feb. 24, 1981

[30] Foreign Application Priority Data

Feb. 28, 1980 [FR] France ..... 80 04481

[51] Int. Cl.[3] ..... H05F 3/02

[52] U.S. Cl. ..... 361/233; 361/225

[58] Field of Search ..... 361/233, 229, 225; 204/164

[56] References Cited

U.S. PATENT DOCUMENTS

| | | | |
|---|---|---|---|
| 878,273 | 2/1908 | Chapman | 361/229 X |
| 3,391,314 | 7/1968 | Carter | 361/229 |
| 3,763,410 | 10/1973 | Phillips | 361/229 |

FOREIGN PATENT DOCUMENTS

| | | | |
|---|---|---|---|
| 1300088 | 12/1972 | United Kingdom | 361/233 |

*Primary Examiner*—Reinhard J. Eisenzopf

*Attorney, Agent, or Firm*—Larson and Taylor

[57] ABSTRACT

For treating textile yarns by electrical discharge, the yarn is caused to travel along a path within at least one module. The module has a first and a second electrode confronting each other. A generator is connected to the electrodes to provide a voltage sufficient to strike an arc. The power of the generator and the impedance of the circuit are such that the arc is quenched after striking in a time which is short as compared to the time of rise to the arc striking voltage.

11 Claims, 9 Drawing Figures

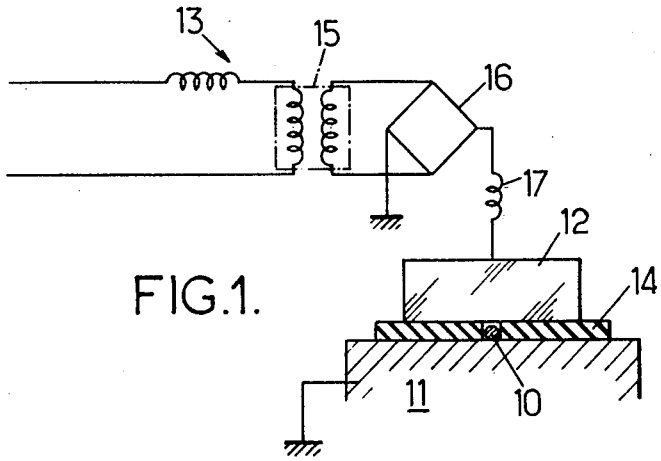
FIG.1.
FIG.2.
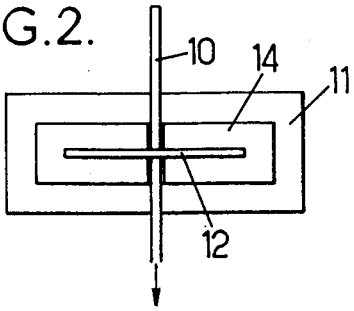
FIG.3.
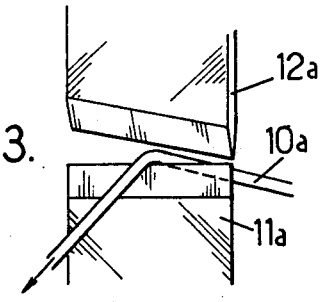
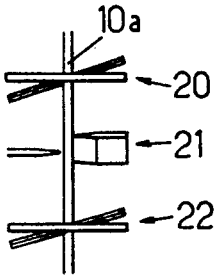
FIG.4.
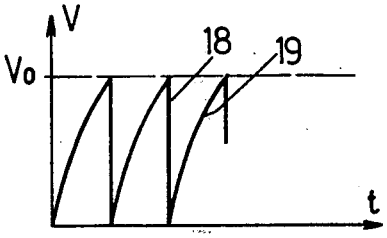
FIG.5.
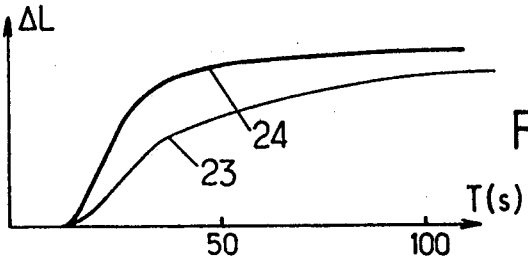
FIG.6.

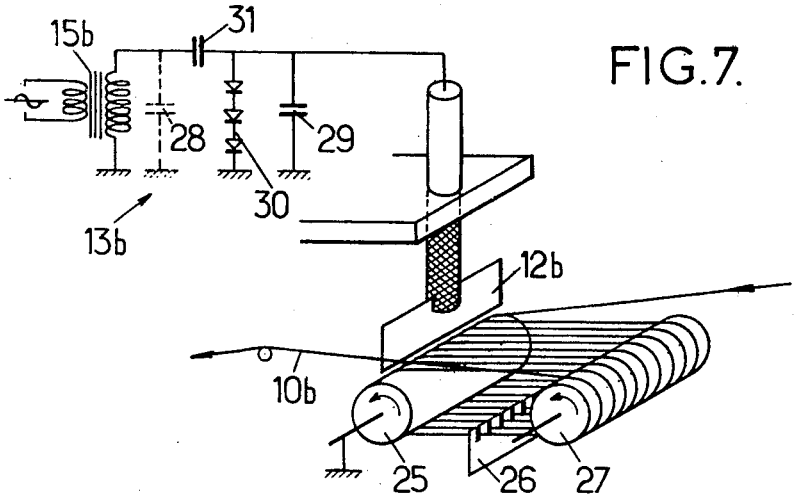
FIG.7.
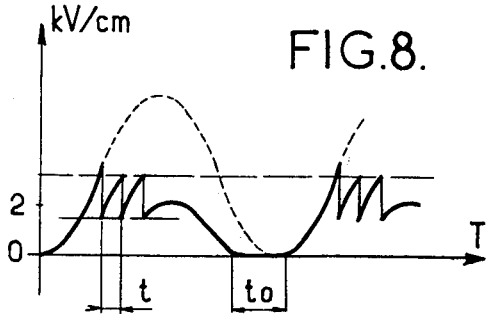
FIG.8.
FIG.9.
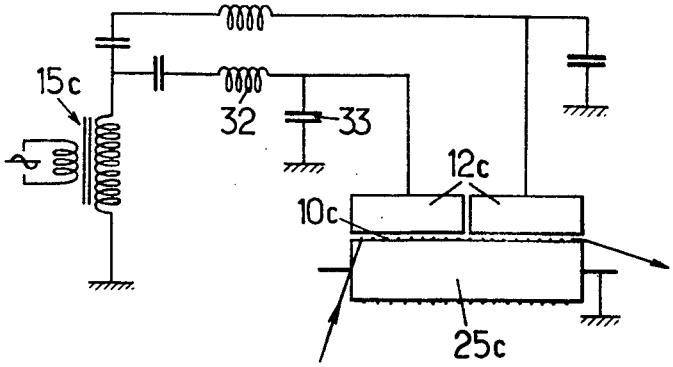

ELECTRICAL TREATMENT OF TEXTILE YARN OR FIBERS

BACKGROUND AND SUMMARY OF THE INVENTION

In the textile industry, it is often necessary to treat yarns, particularly to increase their wettability with respect to dyeing baths or other chemical substances. The word "yarn" as used in the present specification must be understood with a wide sense, including natural fibers, for example cotton, and synthetic fibers, in monofilament and multifilament form.

It is old in the art to subject a yarn to an electrical discharge. More precisely, the yarn is passed through an AC discharge between a dielectric-coated cylinder and a metal plate. Such a treatment has drawbacks. It requires considerable electric power. The fiber must remain several seconds in the discharge if a modification of the fiber is to be obtained. Such a time duration is incompatible with in-line yarn treatments.

In another prior art process (British Pat. No. 1,300,088), the yarn is subjected to an electric arc which is rotated so that the yarn is subjected repetitively to the arc but each time for a short moment. It will be explained later that that approach too has shortcomings.

It is an object of the invention to provide an improved process which requires less consumption of energy and allows high-speed travel of the yarn.

For that purpose, the yarn is passed through a location where an arc is struck and cut at high frequency. Interruption of the arc may be by way of an impedance placed in the electric circuit creating the arc. The time period of repetition will be higher than the duration of an individual arc by at least one and typically several orders of magnitude.

The effect of the interrupted arc, which may be compared to a spark, is very different from that of a sustained arc; this difference may conceivably be attributed to the fact that the interrupted arc strikes at a much higher voltage (at least one order of magnitude) than the permanent voltage of a sustained arc and impresses a much greater energy to the charged particles. The excitation spectrum (spark spectrum) is much richer and the energy levels much higher than in a sustained arc. Furthermore, the use of an interrupted arc avoids the problem created by the use of a sustained arc; due to quenching of the arc, there is no "pick-up" at a point of the moving yarn.

It will in general be necessary for the average current to be at least 400 $\mu$A for a yarn travelling at 5 m/min and to be all the higher the higher the speed of the yarn. The average value of the arc current may further be controlled responsive to the travelling speed of the yarn.

The risk of burning and cutting the yarn is avoided because each discharge is extremely brief; the high repetition frequency of the arcs allows moreover the yarn to be treated over the whole of its length. Each discharge has a high peak power, but involves a low energy.

The process will generally be carried out in air when the only object is improved wettability, since it has the advantage of simplicity. The arc may be fed with DC current or rectified AC current; the second embodiment has the advantage of extinction at each return to zero voltage.

A treatment device according to another aspect of the invention comprises at least one module formed from a first electrode and a second electrode confronting each other at a predetermined distance. An electrical circuit is provided for applying an arc striking voltage between the electrodes. Driving means cause the yarn to travel between the electrodes through a location where the arc appears. The circuit comprises a generator capable of establishing between the two electrodes an arc voltage in the absence of current flow in the circuit, the power of the generator and the impedance of the circuit being such that the arc is interrupted, after striking, in a short time with respect to the rise time to the striking voltage of the arc.

Striking of the arc elsewhere than at the location of the yarn must be avoided. For that, the yarn path may be straddled by dielectric material inducing the arc to strike between the electrodes at the location of the yarn. However, this precaution has generally proved to be superfluous.

In another embodiment, the electrodes are in the form of plates or blades parallel to a same direction and at an angle so as to be closest at the location where the yarn passes.

When it is desired to work with a high yarn speed, it is advantageous to subject this latter to several successive arcs. For that, the device may comprise several modules disposed successively along the path of the yarn and corresponding to several different directions of the arc paths about the yarn. Instead of providing several modules, the yarn may be caused to travel in the form of a coiled winding, whose adjacent turns are in contact or very close to one another and travel under the same plate-shaped electrode.

The invention will be better understood from the following description of particular embodiments given by way of examples only.

SHORT DESCRIPTION OF THE DRAWINGS

FIG. 1 is a simplified illustration of a device according to the invention, in sketch form;

FIG. 2 is a top view of the module of FIG. 1;

FIG. 3 shows a modification of the module of FIGS. 1 and 2;

FIG. 4 shows a possible distribution of successive modules along the path of a yarn to be treated;

FIG. 5 is a curve indicating the variation of the voltage between the electrodes with respect to time in a device having a DC generator;

FIG. 6 illustrates the results of tests carried out on a yarn when untreated and when treated according to the invention;

FIG. 7 is a simplified diagram showing the main elements of another embodiment;

FIG. 8 shows the general shape of the variation of the electric field plotted against time in a device according to FIG. 7, as it appears on an oscillograph;

FIG. 9, similar to FIG. 1, shows yet another embodiment.

DETAILED DESCRIPTION OF PREFERRED EMBODIMENTS

Referring to FIG. 1, there is shown a device for subjecting yarn 10 to be treated to an arc produced at a single location. It comprises an electrically conducting support 11, such as a plate or a drum for driving yarn 10, forming a first electrode. It further comprises a metal strip or blade 12 forming a second electrode. An electric generator 13 delivers, between electrodes 11 and 12, a voltage sufficient to strike an arc between the electrodes. To position the arc at the location of yarn 10, the latter may be straddled by plates 14 of dielectric material plates, of polished beryllium oxide for example, defining a travel path for the yarn and serving as a support for strip 12. The latter must be as close as possible to yarn 10. Experience has however shown that the plates are frequently unnecessary and that the yarn channels the electrical discharge.

Generator 13 must be capable of establishing the voltage necessary for striking an arc. It must also be designed to quench the arc as it results in circulation of an electric current. A voltage of constant or alternating polarity may be provided, advantageously at a high frequency of the order of one kHz at least.

The use of a voltage of constant polarity has an advantage when the nature of the charges influences the transformation of the yarn. For example, darts or "streamers" which appear when the electrode strip 12 is positive, are formed of particles charged with sufficient kinetic energy to open chemical links.

The means for interrupting the arc may be formed by an impedance of sufficient value serially connected in the circuit. The impedance will be a resistor in the case of a DC voltage, an inductance in the case of an AC or pulsed voltage, the latter solution reducing the Joule losses.

In the embodiment shown in FIG. 1, generator 13 comprises a step-up transformer 15 to which an AC voltage is applied, either from the distribution network, or from a high frequency chopper or oscillator. A rectifying bridge 16 allows half-waves all of the same polarity to be applied to electrode 12 through an inductance 17. Electrode 11 is grounded.

Generator 13 must be capable of supplying the striking voltage $V_o$ (FIG. 5) which will be at least 2 kV and generally between 5 and 20 kV.

Operation of the device is as follows.

Assuming no current flows in the circuit, the voltage applied by generator 13 to electrodes 11 and 12 increases until it reaches the striking voltage $V_o$ of an arc. The arc passes round the yarn and penetrates it. The arc current causes a substantially instantaneous voltage drop, shown at 18 in FIG. 5. As soon as the value of the current falls below a value of the order of 1 A, the arc cuts off. The voltage, which had fallen practically to zero, rises again following an approximately exponential law, as shown at 19 in FIG. 5. As soon as the voltage again reaches value $V_o$, corresponding to striking, the cycle is reproduced.

The duration of a cycle is extremely brief, so that there is no risk of burning and cutting the yarn, without it being necessary to cover support 11 with a dielectric coating, as in prior art AC discharge treatment devices.

The average electrical current, for yarns of current diameter, must be at least 400 $\mu$A for a travelling speed of a few meters per minute. The average current must obviously increase with the speed. An average current of the order of a mA may be typical for a speed of 50 m/min.

In the modified embodiment shown in FIG. 3, yarn 10*a* passes through a module whose electrodes are formed from two strips 11*a* and 12*a*. The two strips are flat with a chamfered edge. They are parallel to the same direction but are at an angle, typically greater than 10°. Thus, the distance between the chamfered ends varies along the edges and is minimum at a location where yarn 10*a* is caused to pass.

The operation of such a device is as already described with reference to FIGS. 1 and 2.

It will often be desirable to subject the yarn to several successive discharges. For that, support 11 of FIG. 1 may be a drum on which the yarn rests and which travels in front of a plurality of electrode strips evenly distributed in the circumferential direction.

Several successive modules 20, 21, 22 of the type shown in FIG. 3 may be distributed along the path followed by yarn 10*a*. The successive modules advantageously have different angular positions about the yarn so that the latter is treated evenly around its periphery.

As an example, the effects of the treatment of the invention have been compared with those of the conventional alternating-discharge treatment on a cotton yarn.

For that, the shrinkage of the yarn soaked in a 23%-by-weight soda solution and containing 3 $cm^3$ per liter of a wetting agent (MERCEROL) was measured. The variation in length $\Delta L$, with respect to time T, is shown in FIG. 6. Curve 23 shows the variation for an untreated yarn. Curve 24, in thicker line, shows the variation of a yarn after treatment by twenty modules of the kind shown in FIG. 3, with a travelling speed of 5 m/min and an average current of 400 $\mu$A for each module. Curve 24 is substantially the same as that which is obtained for a conventional machine. It will be appreciated that the invention provides substantially the same result as the prior process, but with a much shorter treatment time.

In the embodiments shown in FIGS. 1 to 4, each electrode treats only one yarn and once.

That shortcoming is overcome in the embodiment shown in FIG. 7 where the yarn to be treated 10*b* circulates as a coil with adjacent turns placed in contact or slightly spaced apart. The yarn is driven and guided by two rolls 25 and 27, whose axes will in general be parallel, and a guide comb 26. The interrupted arc is then formed between the yarn where this latter is supported by roll 25 and a strip electrode 12*b*, similar to that shown in FIG. 1, located in a plane passing through the axis of the roll. Thus, the number of passes of the yarn under the same electrode is multiplied.

Apparently, the arc will strike preferentially at certain passage locations. Experience has shown that this is not so and even that the location struck by a spark has a repulsive effect on the next spark. The fact that the yarn has become electrically conducting where it has been struck by the arc and that it rapidly flows the charges which cannot accumulate on the yarn results in the next strike to take place elsewhere. Satisfactory distribution of the discharges may be checked visually; due to the persistance of the visual impressions, a curtain of discharges should be seen to appear affecting the whole "packet" of yarn.

This same visual test allows to check that the device delivers sparks, which are whiter in appearance than sustained arcs; operation may moreover be easily changed from sustained arc operation to interrupted arc (spark) operation by reducing the power of the generator or increasing the travelling speed.

Generator 13*b* shown in FIG. 7 comprises, like the generator shown in FIG. 1, a step-up transformer 15*b* whose primary winding receives an alternating voltage advantageously at a high frequency, greater than that of the distribution network, and at which the distributed stray capacity 28 of the transformer is generally no longer negligible.

To avoid the appearance of a sustained arc, the circuit comprises an impedance formed by a capacitor 29 placed as close as possible to electrode 12*b* and which spaces apart in time the interrupted arcs, due to the time required for reloading and voltage rise. The resultant time intervals avoid arc maintenance due to residual ionization. Since a sustained arc strikes more easily on a negative half-wave, rectifiers 30 are connected so as to apply positive half-waves only. The presence of capacitor 31 avoids a corresponding power consumption.

A device designed for treating polyester material yarns comprised a transformer feeding a circuit having capacitors 29 and 31 of 70 and 500 pF, respectively. The transformer was supplied at 2 kHz, i.e. at a value close to that of its tuning frequency (2.5 kHz) and supplied a peak voltage of 15 kV.

The voltage of the terminals of the arc (between electrodes 12*b* and 25) had then the form shown in FIG. 8: time $t_o$, determined by the time for reloading capacitor 31 through rectifiers 30, was considerably longer than the time t between arcs. The latter was about 50 μs whereas the duration of each arc was several ns only.

The very nature of the circuit of FIG. 7 results in a single spark striking at one and the same time, which limits the number of sparks striking the yarn during treatment. The limitation may be overcome by fractionating the electrode connected to the generator into several decoupled strips. The embodiment of FIG. 9 comprises two strips 12*c* each placed opposite a respective zone of drum 25*c*. Each strip 12*c* is supplied by transformer 15*c* through a quenching impedance (which may be an inductance 32 of a few μH when operating in AC current) and is decoupled by a capacitor 33. There can thus be provided simultaneously two arcs to yarn 10*c*.

We claim:

1. A process for treating textile yarns by electric discharge, comprising circulating a yarn through a predetermined location between two electrodes, applying an increasing voltage across said electrodes until an arc is struck between said electrodes, quenching said arc and repeating said arc striking and quenching at a high frequency, the time period between two successive ones of said arcs being greater by at least one order of magnitude than the duration of an individual one of said arcs.

2. A process according to claim 1, wherein said yarn supported by a conducting surface is caused to travel several times under a same strip-shaped electrode placed in the immediate vicinity of the yarn, and said strip electrode is brought up to a voltage which is at least equal to 2 kV in the absence of an arc current.

3. A process according to claim 1, wherein the frequency and the intensity of the arcs is selected for the average current to be of at least 400 μA for a yarn travelling at about 5 m/min.

4. A device for treating textile yarns by electrical discharge, comprising at least one module having a first electrode and a second electrode confronting each other and at a predetermined distance, means for causing the yarn to travel between the electrodes at an arc location and an electric circuit for applying voltage between the electrodes, including a generator constructed to provide across the two electrodes a voltage sufficient to strike an arc between said electrodes in the absence of current flow in the circuit, the power of said generator and the impedance of said circuit being such that the arc is interrupted after striking in a time which is brief with respect to the time of rise to the arc striking voltage.

5. A device according to claim 4, wherein one of said electrodes is connected to a supply transformer through a capacitor and is connected in parallel with rectifier means.

6. A device according to claim 4, wherein one of said electrodes is connected to a supply transformer through inductive impedance means and said electrodes are connected in parallel with capacitor means.

7. A device according to claim 4, wherein said electrodes are formed by strips parallel to the same direction and forming therebetween an angle so as to be closest at the location where the yarn passes.

8. A device according to claim 4, wherein one of the electrodes is a rotary drum supporting the yarn and the other of said electrodes is a strip disposed in a plane passing through the axis of the drum.

9. A device as claimed in claim 8, further comprising means for causing the yarn to travel over several successive turns on said drum at locations confronting the strip.

10. A device according to claim 9, wherein the strip is in several fractions each of which confronts an axial fraction of the rotary drum and is connected to a supply transformer through a separate impedance, each fraction cooperating with several turns of the yarn.

11. A device according to claim 4 or 10, further comprising capacitor means across said electrodes, said generator being connected in series with said electrodes and capacitor via said impedance.

* * * * *